United States Patent [19]

Nikolas

[11] Patent Number: 5,048,378

[45] Date of Patent: Sep. 17, 1991

[54] TOOL AND METHOD FOR FAUCET NUT INSTALLATION

[76] Inventor: William F. Nikolas, 10708 Old River School Rd., Downey, Calif. 90241

[21] Appl. No.: 611,824

[22] Filed: Nov. 13, 1990

[51] Int. Cl.[5] ..... B25B 13/00
[52] U.S. Cl. ..... 81/124.2; 81/176.15
[58] Field of Search ..... 81/176.15, 176.2, 124.2

[56] References Cited

U.S. PATENT DOCUMENTS

| | | | |
|---|---|---|---|
| 3,071,995 | 1/1963 | Ruthrauff, Jr. | 81/124.2 |
| 3,086,414 | 4/1963 | Nardi | 81/124.2 |
| 3,151,512 | 10/1964 | Charczenko . | |
| 3,578,046 | 11/1971 | Curran . | |
| 4,291,429 | 9/1981 | Servadio . | |
| 4,357,845 | 11/1982 | Cornea | 81/124.2 X |
| 4,450,919 | 5/1984 | Cousineau . | |
| 4,466,315 | 8/1984 | Boschetto, Jr. et al. . | |
| 4,587,770 | 5/1986 | Lindberg . | |
| 4,818,157 | 4/1989 | Kouvelis . | |
| 4,823,650 | 4/1989 | Tuttle | 81/124.2 |

OTHER PUBLICATIONS

Tub and Shower Valve Wrenches, Part Nos. 5300–5307, PASCO Tool Catalog; p. D–19; 8/89.
Strainer Wrench, Part No. 4948; Aug. 1989.

*Primary Examiner*—James G. Smith
*Attorney, Agent, or Firm*—Charles H. Thomas

[57] ABSTRACT

A tool is provided for installing a faucet nut on a faucet assembly at the underside of a lavatory. The tool allows installation of the faucet nut to be performed with an electric drill, rather than manually, thereby greatly reducing the time required for installation of a faucet nut. The tool has a hollow socket and shaft which fits into the jaws of a drill chuck and a hollow socket. The shaft is attached to the blind end of the socket and the opposite, open end has a hexagonal cross section with four radial notches. The configuration of the open end is such as to accommodate a great number of the types of faucet nuts commercially employed in faucet lavatory installations. The faucet nut is initially engaged on the faucet nipple, and the tool is used to drive the faucet nut along the length of the nipple and into abutment against the underside of a lavatory. The coupling between the shaft and the socket allows limited pivotal movement therebetween, so that the drill can be manipulated to avoid obstructions beneath the lavatory.

14 Claims, 2 Drawing Sheets

TOOL AND METHOD FOR FAUCET NUT INSTALLATION

BACKGROUND OF THE INVENTION

1. Field of the Invention the present invention relates to a tool and method for installing faucet nuts on faucet assemblies at the underside of a lavatory.

2. Description of the Prior Art

In conventional practice faucet assemblies are secured to kitchen, bathroom and utility room lavatories or sinks by means of a faucet nut disposed on the underside of a lavatory. The faucet nut is threadably engaged on a relatively large diameter, hollow tubular, externally threaded nipple that extends from the faucet body downwardly through an opening in the lavatory counter to depend from the underside of the lavatory. Typical residential plumbing faucet assemblies have faucet nipples which are three quarters of an inch in nominal outer diameter.

The faucet assembly normally includes an annular collar which surrounds the faucet valve assembly and which rests atop the upper surface of the lavatory about the periphery of an opening through the lavatory counter. The faucet nipple extends downwardly through the opening and past the collar. The faucet nipple is normally formed of brass, although other metals and hard plastics may be utilized. The faucet nut may likewise be formed of brass, but more typically is formed of a hard plastic such as Delrin.

To install a faucet assembly according to conventional practice, a plumber first places the faucet assembly atop the lavatory with the faucet nipple extending down through an opening in the lavatory counter to protrude through the undersurface of the lavatory counter. The plumber then manually engages the faucet nut on the depending nipple and manually advances the nut the full length of the nipple until the faucet nut resides in abutment against the undersurface of the lavatory counter or plumbing fixture.

The plumber then tightens the faucet nut with his fingers as tightly as possible. However, in order to adequately secure the faucet assembly to the lavatory, it is normally necessary to utilize some implement to advance the faucet nut along the last few threads of the nipple against the underside of the lavatory counter or fixture so as to firmly clamp the faucet assembly, in position against the lavatory counter or fixture. According to conventional practice a plumber will typically employ either a basin wrench or a channel lock wrench in the final stages of tightening the faucet nut in order to adequately secure it.

The present system for installing plumbing faucet nuts is quite laborious and time consuming. The downwardly depending portion of a faucet nipple may extend from the underside of the lavatory counter up to about three inches in length. Thus, the plumber is forced to tediously advance the faucet nut in threaded engagement throughout this protruding length of the faucet nipple. A plumber who must spend several hours installing a number of faucets in this manner will invariably experience considerable soreness of the fingers, shoulders or back. Furthermore, since manual advancement of faucet nuts proceeds so slowly, a considerable amount of the plumber's time is consumed in the process.

The final tightening techniques employed have likewise been unsatisfactory. The depending faucet nipple normally is located within a narrow area that is laterally confined between the structure of the lavatory basin that extends downwardly well past the faucet nipple, and a wall located closely adjacent thereto. The nature of basin wrenches and channel lock wrenches is such that those devices require a considerable lateral area to accommodate the swing of the wrench handles in order to obtain adequate leverage to tighten a faucet nut.

Where faucet nipples are located in narrow areas, as is typically the case, the plumber must sacrifice the leverage required for controlled tightening of the faucet nut. Instead, the plumber must attempt to undertake tightening of the faucet nut with the wrench handle varying from the axis of the faucet nipple by only a few degrees. As a consequence, the leverage obtained is very poor, thereby requiring an application of considerable strength to adequately tighten the faucet nut. Furthermore, a basin wrench or channel lock wrench operated in this manner cannot satisfactorily engage a faucet nut. Consequently, such a tool is quite likely to slip off of the faucet nut as the plumber attempts installation. This sometimes leads to damage of the faucet nut, and in any event significantly lengthens the time required to install the faucet.

SUMMARY OF THE INVENTION

According to the present invention a tool is provided which greatly facilitates the installation of a faucet assembly and which substantially reduces the time required for installation. The tool is an implement adapted for attachment to an electric drill, preferably a cordless electric drill. The tool has a socket or barrel and a drive shaft coupled to the socket. The shaft fits into the jaws of the drill chuck. The socket or barrel is of a hollow, tubular configuration that has an opening big enough to fit over and encompass the depending nipple of a faucet assembly. The tool socket has a blind end which is attached to the shaft and an opposite open end. The walls of the open end are formed in a hexagonal cross section having four radial notches therein located ninety degrees apart.

The tool is designed to drive on a faucet nut that is adapted for engagement with the threaded nipple of a faucet that extends downwardly on the underside of a lavatory. The tool is devised so as to advance the faucet nut along the entire, exposed length of the faucet nipple into abutment against the underside of the lavatory, and to further advance the faucet nut so as to firmly clamp the faucet assembly into position on the lavatory counter.

The faucet nuts which the tool of the invention is designed to install are internally threaded and have a plurality of radially projecting ribs, ridges or wings. While faucet nuts of the same and different manufacturers have different configurations, the preferred embodiment of the tool of the invention may be utilized to quickly and firmly engage those commercially available types of faucet nuts which are most widely used, both during installation and removal.

The faucet installation tool of the invention greatly facilitates and speeds up the installation of a faucet nut according to the method of the invention. The tool, once secured in the drill chuck, is oriented so that it is at least in nearly axial alignment with the faucet nut and the nipple. The radial notches at the open end of the tool socket engage the radially extending flanges or wings of some of the most widely utilized faucet nuts. Other types of faucet nuts which enjoy widespread commercial usage are engaged entirely within the walls of the tool socket. In any event, the drill is merely operated so that the socket turns the faucet nut in continuous advancement along the full length of the depending faucet nipple. A faucet nut may thereby be firmly and unerringly clamped in position against the undersurface of a lavatory counter in just a few seconds time and with far less difficulty than with present faucet nut installation techniques.

In one broad aspect the present invention may be considered to be a plumbing tool for installing a faucet nut on a threaded nipple of a faucet assembly. The plumbing tool is comprised of a socket having a blind end and an opposite hexagonal end with an opening large enough to circumscribe the nipple. The open, hexagonal end is formed by six walls of equal length and uniform thickness throughout. The walls are arranged in first, second and third pairs, the walls within each pair being mutually opposing. The socket is formed with a first set of diametrically opposed radial longitudinal slots at all demarcations between the walls in the first and second pairs. A second set of diametrically opposed slots are oriented perpendicular to the first set of slots and bisect each of the walls in the third pair of walls. A drive shaft is coupled to the blind end of the socket and is adapted to fit into the jaws of a chuck of a cordless electric drill.

In the preferred embodiment of the invention the walls within each pair of walls are separated from each other by a distance of about one and five thirty-seconds of an inch. The radial slots in one of the pairs of slots are each about three-sixteenths of an inch in width, while the radial slots in the other pair of slots are each about three eighths of an inch in width. The socket preferably has a depth of at least about three inches. A socket constructed of such a size is able to accommodate the most widely employed faucet nuts which are utilized in residential faucet plumbing installations.

A further preferred feature of the plumbing tool of the invention is an arrangement by which the drive shaft is coupled to the blind end of the socket by a coupling which permits limited pivotal movement between the drive shaft and the socket. In installing faucet assemblies a plumber is frequently faced with the problem of obstructions beneath the lavatory, such as lavatory water supply lines, drain traps, garbage disposals and other immoveable objects about which the plumber must work.

The provision of the tool with a coupling between the drive shaft and the barrel of the socket that allows limited pivoting movement therebetween provides the plumber with considerable flexibility in avoiding obstructions beneath the lavatory that lie directly below the faucet installation. That is, the electric drill can be positioned at a slight angle relative to the axis of the faucet nipple and faucet nut and still drive the faucet nut firmly into position quickly and easily.

In another aspect the invention may be considered to be a method of securing a faucet nut onto a threaded nipple of a faucet assembly that extends downwardly to a lower extremity from an undersurface of a lavatory. The method utilizes a tool having a barrel with a blind end that has a drive shaft extending therefrom and an opposite open end that defines an opening of hexagonal cross section. The method also utilizes an electric drill having a chuck with closeable jaws.

The method of the invention is comprised of the steps of inserting the drive shaft of the tool between the jaws of the drill chuck, closing the chuck jaws on the drive shaft, engaging the faucet nut on the lower extremity of the nipple and engaging the faucet nut in the opening of the barrel. The electric drill is then operated to threadably advance the faucet nut on to the threaded nipple and into abutment against the undersurface of the lavatory. Preferably, the electric drill can be oriented slightly off center from the axis of the barrel to drive the drive shaft. The plumber is thereby able to avoid obstructions beneath the lavatory which lie directly beneath the faucet assembly.

The invention may be described with greater clarity and particularity by reference to the accompanying drawings.

DESCRIPTION OF THE EMBODIMENT AND IMPLEMENTATION OF THE METHOD

Figure 1:
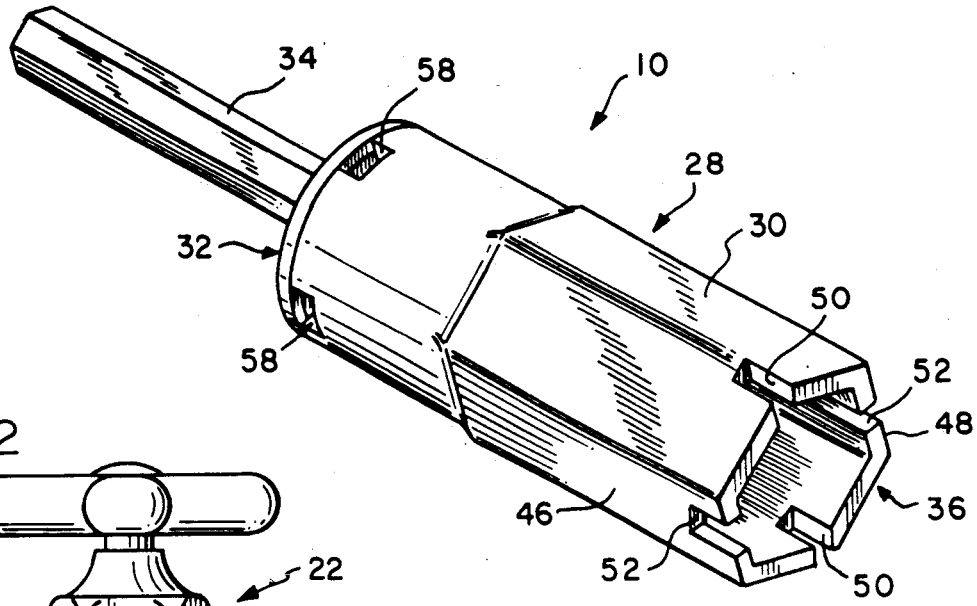
FIG. 1 is a perspective view of a tool constructed according to the invention.
Figure 2:
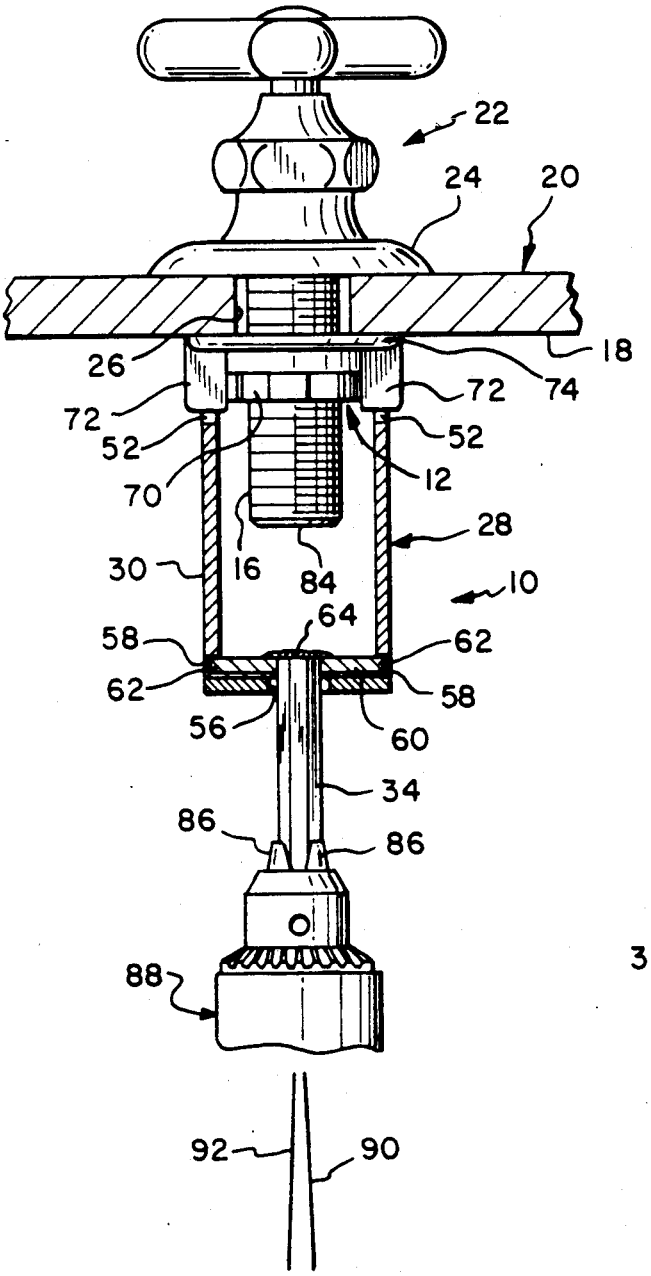
FIG. 2 illustrates the manner of utilization of the tool of FIG. 1 according to the method of the invention.
Figure 6:
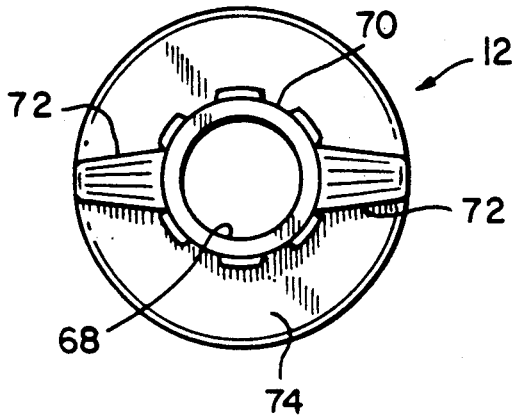
FIG. 6 is a top plan view illustrating one widely employed faucet nut which the tool of the invention can be used to install.

FIG. 1 illustrates a plumbing tool 10 for securing a faucet nut, such as the faucet nut 12 of FIG. 6 onto a threaded faucet nipple 16 at the underside 18 of a lavatory counter 20, in the manner depicted in FIG. 2. In such an installation a faucet assembly 22 is mounted on the lavatory with an annular collar or faucet base 24 disposed atop the upper surface of the lavatory counter 20. The threaded faucet nipple 16 extends through an opening 26 in the lavatory counter 20 and depends therebeneath, as illustrated in FIG. 2.

The structure of the tool 10 is illustrated in FIGS. 1-5. The tool 10 is comprised of a steel socket 28 including a tubular, hollow barrel 30 having a blind end 32 with a steel drive shaft 34 extending therefrom and an opposite open end 36. The barrel 30 has a hexagonal configuration at its open end 36 with six walls 38, 40, 42, 44, 46 and 48 of equal length and uniform thickness throughout.

Figure 3:
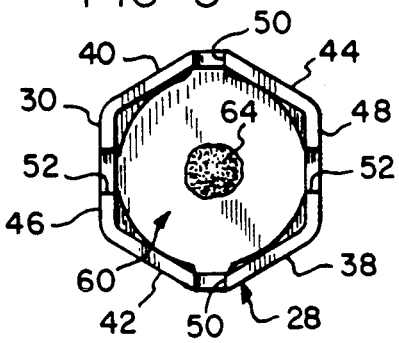
FIG. 3 is an end view of the open end of the socket of FIG. 1.

The walls 38-48 are arranged in three pairs of walls with the walls within each pair residing in mutually opposing relationship. That is, the walls 38 and 40 in the first pair of walls and are disposed in diametrically opposed parallel relationship at a distance of one and five-sixteenths inches from each other, as illustrated in FIG. 3. Likewise, the walls 42 and 44 form a second pair of walls and are similarly spaced apart diametrically opposite and parallel to each other a distance of one and five-sixteenths inches. The walls 46 and 48 forming the third pair are also mutually parallel and located diametrically opposite each other and are likewise separated from each other by a distance of one and five-sixteenths inches. This distance of separation and configurations of the open end 36 of the barrel 30 is particularly advantageous in that it allows the socket 10 to be employed with faucet nuts of widely differing configurations, such as the faucet nuts 12–15 depicted in FIGS. 6–9, as will hereinafter be described.

The walls 38 and 40 of the first pair of walls and the walls 42 and 44 of the second pair of walls are separated from each other by a first set of diametrically opposed radial slots 50, as illustrated in FIGS. 1 and 3. The walls 46 and 48 in the third pair are bifurcated by a second set of diametrically opposed radial slots 52. The slots 52 in the second set are oriented perpendicular to the first set of slots 50. The slots 50 in the first set each define a gap of about three sixteenths of an inch in width, while the slots 52 are each about three eighths of an inch in width. The slots 50 and 52 all extend about three eighths of an inch longitudinally along the barrel 30 from the open and 36 thereof. The barrel 30 has a length of at least about three inches between the blind end 32 and the open end 36.

Figure 4:
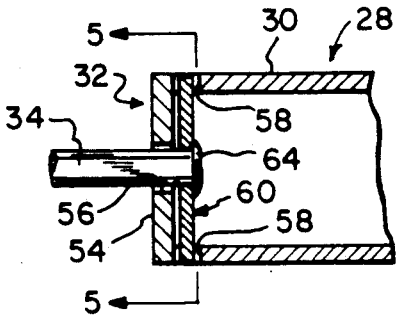
FIG. 4 is a side elevational detail illustrating the coupling between the drive shaft and the tool socket.
Figure 5:
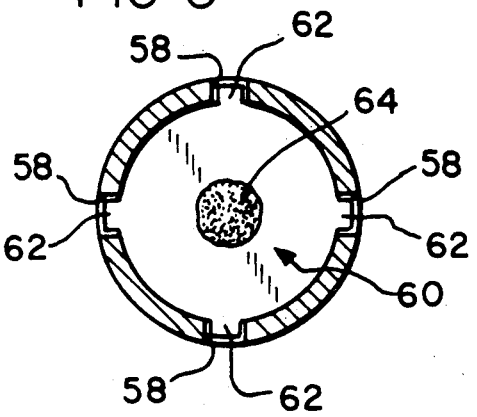
FIG. 5 is a transverse sectional view taken along the lines 5-5 of FIG. 4.

The tool 10 is preferably configured with a coupling between the drive shaft 34 and the barrel 30 which allows limited pivotal movement therebetween. This feature is best illustrated in FIGS. 2, 4 and 5. Specifically the blind end 32 of the barrel is formed by a disk-shaped flat steel end plate 54 having a central axial opening 56 therethrough. The end plate 54 is welded to the walls of the cylindrical portion of the barrel 30 at the blind end 32 thereof. Together the end plate 54 and the barrel 30 form the socket 28.

The barrel 30 is formed with at least a pair of diametrically opposed radial openings 58 adjacent the flat end plate 54. In the embodiment illustrated four such radial openings 58 are defined in the barrel 30 at equally spaced ninety degree intervals thereabout. Each of the openings 58 is formed as a longitudinal slot in the cylindrical end of the barrel 30. Each slot extends over an arcuate distance of about five sixteenths of an inch and lengthwise a distance of about three sixteenths of an inch. The slots are all closed by the end plate 54 at the blind end 32 of the socket 28, so as to form the radial openings 58.

The coupling between the drive shaft 34 and the socket 28 is also comprised of a coupling member in the form of a generally disk shaped steel plate 60, illustrated in FIGS. 2, 4 and 5. The disk shaped plate 60 is formed of steel about three thirty-seconds of an inch in thickness and has four radially extending tangs 62 each extending over an arcuate distance of about one quarter of an inch at the periphery of the coupling plate 60. The tangs 62 thereby extend loosely into and ar captured within the lateral openings 58 in the socket 28. The relative dimensions of the tangs 62 and lateral openings 58 are such that the coupling plate 60 can tilt through an angle of perhaps as much as ten degrees from axial alignment with the barrel 30, to the extent allowed by the longitudinal dimensions of the radial openings 58. However, the coupling plate 60 and the barrel 30 are constrained to move in rotation together.

The drive shaft 34 has a hexagonal configuration and is preferably three eighths of an inch across. The drive shaft 34 extends through the central axial opening 56 in the flat end plate 54 of the socket 28 and into the barrel 30, as depicted in FIG. 4. The interior end of the shaft 34 fits into a central axial opening in the coupling plate 60 and is rigidly secured thereto by a central weld 64, visible in FIGS. 4 and 5.

The tool 10 may be employed to secure different faucet nuts onto threaded faucet nipples of faucet assemblies, such as the faucet assembly 22, despite significant variations in the configurations of the faucet nuts. For example, FIG. 6 illustrates a faucet nut 12 of the type manufactured by Price Pfister Company. The faucet nut 12 is sold primarily through retail hardware and home repair supply outlets and is constructed of hard plastic, with an internally threaded central axial opening 68. The opening 68 is three quarters of an inch in diameter and is surrounded by an engaging annular collar 70 having a nominal outer diameter of about one inch with a pair of diametrically opposed radially projecting wings or lugs 72. The wings 72 extend outwardly a distance equal to the circumference of the annular base flange 74, which is about one and three quarter inches in outer diameter. The lugs 72 are both about five sixteenths of an inch in width at the periphery of the collar 70 and about three sixteenths of an inch in width at the periphery of the base flange 74.

The implementation of the method of the invention is best illustrated in FIG. 2. As depicted in that drawing figure the threaded nipple 16 of the faucet assembly 22 extends downwardly to a lower extremity 84 from an underside 18 of the lavatory counter 20. The drive shaft 34 of the tool 10 is inserted between the jaws 86 of a drill chuck 88 of a cordless electric drill. A cordless drill is preferable to avoid excessive torque on the faucet nut and to avoid the hazard of using relatively high voltage alternating current. The drill chuck jaws 86 are closed on the drive shaft 34. A faucet nut, such as the faucet nut 12 depicted, is engaged on the lower extremity 84 of the nipple 16.

When the tool 10 is employed to fasten the faucet nut 12 into position on the threaded nipple 16 of the faucet assembly 22, as depicted in FIG. 2, the open end 36 of the socket 28 is placed against the base flange 74 such that the faucet nut collar 70 is encompassed within the walls 38–48 of the barrel 30. The lugs 72 are of a size which seat within the larger slots 52 in the barrel 30. The electric drill is then operated to rotate the shaft 34. The shaft 34 in turn rotates the coupling plate 60. The radially projecting tangs 62 thereupon drive the socket 28 in rotation by virtue of engagement within the lateral openings 58 in the wall of the barrel 30. When the drill is operated the socket 28 is rotated. The faucet nut 12 is carried in rotation with the socket 28 since the opposing lugs 72 are captured within the radial slots 52. The faucet nut 12 is thereby threadably advanced onto the threaded nipple 16 and into abutment against the undersurface 18 of the lavatory counter 20, as illustrated.

As is apparent in FIG. 2, the electric drill can be orientated off center from the axis of the barrel 30 and also the axis of the threaded nipple 16, which is indicated at 92. The drill can thereby be oriented to avoid obstructing structures that lie beneath the sink 20 and still drive the faucet nut into full engagement in merely a matter of seconds.

Figure 7:
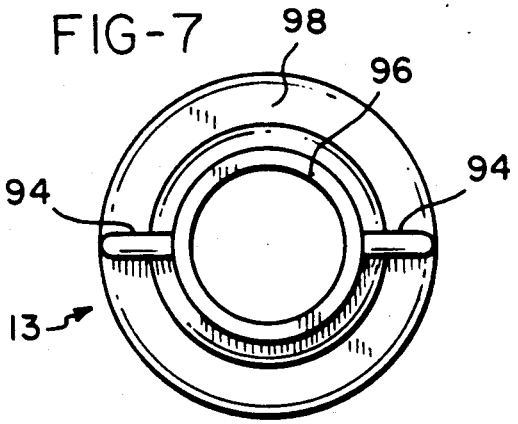
FIGS. 7, 8 and 9 are top plan views of other widely employed faucet nuts of different configurations which the tool of the invention can be used to install.

The tool 10 can also be employed to drive faucet nuts of widely differing configuration onto the threaded faucet nipple 16, as well as the faucet nut 12. The faucet nut 13 of FIG. 7 is another faucet nut manufactured by Price Pfister. The faucet nut 13 was sold to the retail trade for many years prior to the faucet nut 12. Like the faucet nut 12, the faucet nut 13 has an internally threaded three quarter inch diameter central opening 68 and a pair of diametrically opposed, wings 94 that project radially outwardly from a central collar 96 atop an annular base flange 98. The collar 96 has an outer diameter of about one and one sixteenth inches while the outer diameter of the base flange 98 is about one and three quarter inches in diameter. The wings 94 are both about one eighth of an inch in width and are of uniform width throughout. When the tool 10 is employed to install the faucet nut 13, it is operated in the same manner as depicted in FIG. 2 with the exception that the wings 94 are received in the narrower slots 50 rather than the wider slots 52 of the socket 28.

Figure 8:
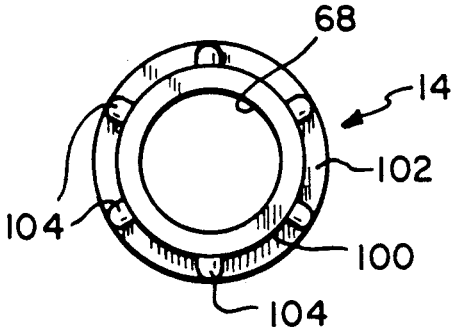

The tool 10 can also be employed to install the faucet nut 14 depicted in FIG. 8. The faucet nut 14 is also manufactured by Price Pfister but is sold primarily through wholesale plumbing supply house The faucet nut 14 has the same three quarter inch internally threaded central opening 68 and an annular collar 100 having an outer diameter of about one and one sixteenth inches and an annular base flange 102 about one and thirteen sixteenths inches in diameter. There are six radially projecting ribs 104 directed outwardly from the collar 100 a top the base flange 102.

When the tool 10 is used to install the faucet nut 14, the open end 36 of the socket 28 is placed over the base flange 102 so as to encompass the collar 100 and the ribs 104 therewithin. When the socket 28 is engaged with the faucet nut 14 in this manner four of the ribs 104 fit into the corners between the first and second pairs of walls 38, 40 and 42, 44. The other two ribs 104 fit into the slots 52. When the drill is operated to rotate the socket 28, the faucet nut 14 is carried in rotation therewith since the span of the projecting ribs 104 is greater than the distance of separation of one and five sixteenths inches between the walls in each pair of walls of the open end 36 of the socket 28. The ribs 104 are thereby engaged by the socket walls so that the faucet nut 14 can be installed in the fashion depicted in FIG. 2. Only the manner of engagement between the socket 28 and the faucet nut 14 differs.

Figure 9:
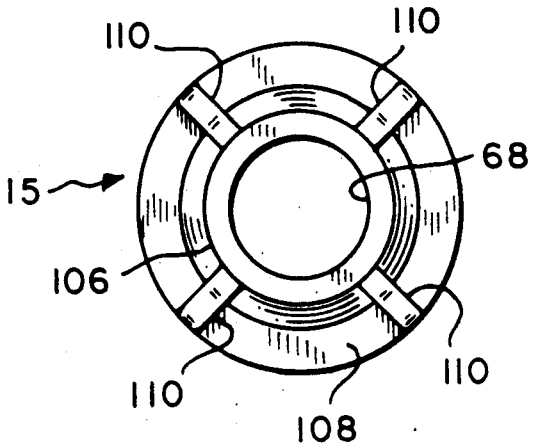

The tool 10 can also be utilized to install the faucet nut 15 depicted in FIG. 9. The faucet nut 15 is of a type manufactured by Delta, Moen, Kohler and American Standard, all manufacturers of plumbing equipment. The faucet nut 15 is likewise formed of a hard plastic with a threaded central opening 68 three-quarter inches in diameter, the same as the central threaded openings 68 of the other faucet nuts described The annular collar 106 of the faucet nut 15 has an outer diameter of about one and three sixteenths inches and resides atop an annular base flange 108 which has an outer diameter of one and one quarter inches. From the annular collar 106 there are four, equally spaced radially projecting wings 110, each about one-eighth of an inch in width.

When the tool 10 is employed to drive a faucet nut 15 onto the threaded faucet nipple 16, the open end 36 of the barrel 30 is placed against the faucet nut 15 such that the radially projecting wings 110 reside in engagement within the four slots 50 and 52 in the barrel 30. The socket 28 thereby engages the faucet nut 15 by means of the radially projecting wings 108. Rotation of the tool 10 carries the faucet nut 15 in rotation. The faucet nut 15 can thereby be installed in the same manner described with reference to FIG. 2. of the drawings.

By employing the tool of the invention and by installing faucet nuts according to the method of the invention, a very considerable amount of time is saved in the installation of plumbing faucet assemblies. Furthermore, the invention avoids the possible damage to plumbing parts and injury to the hands of a plumber that often occurs in a conventional installation by a combined technique of manual finger tightening and final tightening with a basin wrench or a channel-lock wrench.

Undoubtedly, numerous variations and modifications of the invention will become readily apparent to those familiar with plumbing tools. For example, the tool of the invention is useful for commercial plumbing applications as well as for residential applications. Accordingly, the scope of the invention should not be construed as limited to the specific embodiment illustrated and manner of implementation of the method described, but rather is defined by the claims appended hereto.

I claim:

1. A plumbing tool for installing a faucet nut on a threaded nipple of a faucet assembly comprising: a socket having a blind end and an opposite hexagonal end with an opening large enough to circumscribe said nipple and formed by six walls of equal length and uniform thickness throughout arranged in first, second and third pairs, the walls within each pair being mutually opposing, and wherein said socket is formed with a first set of diametrically opposed radial slots at all demarcations between said walls in said first and second pairs and a second set of diametrically opposed radial slots oriented perpendicular to said first set of slots and bisecting each of said walls in said third pair, and a drive shaft coupled to said blind end of said socket and adapted to fit into the jaws of a chuck of an electric drill.

2. A plumbing tool according to claim 1 wherein said walls within each pair of walls are separated by a distance of about one and five thirty-seconds of an inch.

3. A plumbing tool according to claim 1 wherein said radial slots in one of said pairs of slots are each about three sixteenths of an inch in width and said radial slots in the other of said pair of slots are each about three eighths of an inch in width.

4. A plumbing tool according to claim 1 wherein said socket has a depth of at least about three inches.

5. A plumbing tool according to claim 1 wherein said drive shaft is coupled to said blind end of said socket by a coupling which permits limited pivotal movement between said drive shaft and said socket.

6. A plumbing tool according to claim 5 wherein said socket is comprised of an annular end plate having a central axial opening adapted to receive said spindle therewithin and forming said blind end of said socket, and wherein said socket is formed with at least a pair of diametrically opposed radial openings adjacent said end plate, and further comprising a coupling member located within said socket adjacent said end plate and having radially projecting tangs that extend into and are captured within said radial openings in said socket, and said drive shaft is rigidly joined to said coupling member.

7. A plumbing tool for securing a faucet nut onto a threaded faucet nipple at the underside of a lavatory comprising: a tubular, hollow barrel having a blind end with a drive shaft extending therefrom and an opposite open end wherein said barrel has a hexagonal configuration at said open end with six walls of equal length and uniform thickness throughout arranged in first, second and third pairs with the walls within each pair residing in mutually opposing relationship, and said walls of said first and second pairs are separated from each other by a first pair of diametrically opposed radial slots and said walls in said third pair are bifurcated by a second pair of diametrically opposed radial slots, and said pairs of slots are oriented in mutually perpendicular alignment.

8. A plumbing tool according to claim 7 wherein said walls in each pair are located about one and five sixteenths inches from each other.

9. A plumbing tool according to claim 7 wherein said slots in one of said pairs of slots each define a gap of about three sixteenths of an inch in width.

10. A plumbing tool according to claim 7 wherein said slots in one of said pairs of slots each define a gap of about three eighths of an inch in width.

11. A plumbing tool according to claim 7 wherein said barrel has a length of at least about three inches.

12. A plumbing tool according to claim 7 further comprising a coupling between said drive shaft and said barrel which allows limited pivoting movement therebetween.

13. A plumbing tool according to claim 12 further characterized in that said blind end of said barrel is formed by a flat end plate having a central axial opening therethrough secured to said walls of said barrel, and said barrel is formed with at least a pair of diametrically opposed radial openings adjacent said flat end plate, and a coupling member resides within said barrel and has radially projecting tangs that extend into and are captured within said radial openings, and said drive shaft extends into said barrel through said central axial opening in said flat end plate and is rigidly secured to said coupling member.

14. A plumbing tool according to claim 13 wherein four of said radial openings are defined in said barrel at equally spaced intervals thereabout and said coupling member has four of said tangs arranged at equally spaced intervals from each other.

* * * * *